US009502809B2

(12) United States Patent
Komiyama

(10) Patent No.: US 9,502,809 B2
(45) Date of Patent: Nov. 22, 2016

(54) SURFACE MOUNT CONNECTOR

(71) Applicant: Tyco Electronics Japan G.K., Kanagawa (JP)

(72) Inventor: Ryuichi Komiyama, Kanagawa-ken (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 14/683,866

(22) Filed: Apr. 10, 2015

(65) Prior Publication Data

US 2015/0295342 A1 Oct. 15, 2015

(30) Foreign Application Priority Data

Apr. 11, 2014 (JP) ..... 2014-082071

(51) Int. Cl.

| | |
|---|---|
| ***H01R 13/52*** | (2006.01) |
| ***H01R 13/502*** | (2006.01) |
| ***H01R 12/71*** | (2011.01) |
| ***H01R 13/516*** | (2006.01) |
| ***H01R 12/72*** | (2011.01) |

(Continued)

(52) U.S. Cl.

CPC ..... *H01R 13/502* (2013.01); *H01R 12/712* (2013.01); *H01R 12/722* (2013.01); *H01R 13/516* (2013.01); *H01R 12/57* (2013.01); *H01R 13/506* (2013.01)

(58) Field of Classification Search

CPC ..... H01R 23/7073; H01R 23/7005; H01R 23/722; H01R 43/205; H01R 13/5216; H01R 13/2442

USPC ..... 439/79, 325, 328, 329, 541.5, 41, 521, 439/626, 940

See application file for complete search history.

(56) References Cited

U.S. PATENT DOCUMENTS 4,469,387 A * 9/1984 McHugh ..... H01R 12/716 439/140
5,167,531 A * 12/1992 Broschard, III ... H01R 23/6873 439/541.5
5,281,166 A * 1/1994 Yu ..... H01R 12/714 439/571

(Continued)

FOREIGN PATENT DOCUMENTS

EP 1855361 A1 11/2007
JP 2009117219 A 5/2009

OTHER PUBLICATIONS

European Search Report, App. No. EP 15 16 1011, dated Sep. 1, 2015, 6 pages.

(Continued)

*Primary Examiner* — Thanh Tam Le
(74) *Attorney, Agent, or Firm* — Barley Snyder

(57) ABSTRACT

A surface mount connector is disclosed having a housing cover, a contact receiving base, and a first engagement portion. The contact receiving base is connected to the housing cover, having a plurality of contacts with terminating ends and opposite mating ends positioned inside the housing cover. The first engagement portion has a first projection positioned proximate to a mating end of either the housing cover or the contact receiving base, extending orthogonal to a plugging/unplugging direction. The first engagement portion also has a first projection receiving member positioned on the other of the contact receiving base and the housing cover proximate to the mating end, being complimentary to the first projection and receiving the first projection at a terminating end facing surface thereof.

17 Claims, 6 Drawing Sheets

(51) Int. Cl.
*H01R 12/57* (2011.01)
*H01R 13/506* (2006.01)

(56) References Cited

U.S. PATENT DOCUMENTS 5,975,917 A * 11/1999 Wang ..... H01R 43/20 29/884
6,244,901 B1 * 6/2001 Fujii ..... H01R 4/185 439/595
6,383,004 B1 * 5/2002 Gunay ..... H01R 12/61 439/329
6,666,714 B1 * 12/2003 Li ..... H01R 13/506 439/149
7,234,951 B2 * 6/2007 Wang ..... H01R 12/712 439/79
7,357,663 B2 * 4/2008 Wei ..... H01R 12/79 439/260
7,427,213 B2 * 9/2008 Kondou ..... H01R 13/6273 439/541.5
7,578,696 B2 * 8/2009 Yuan ..... H01R 12/716 439/485
8,403,683 B2 * 3/2013 Yao ..... H01R 13/506 439/79
8,961,233 B2 * 2/2015 Lai ..... H01R 13/4361 439/626

OTHER PUBLICATIONS

Abstract of JP2009117219, dated May 28, 2009, 2 pages.

* cited by examiner

SURFACE MOUNT CONNECTOR

CROSS-REFERENCE TO RELATED APPLICATION

This application claims priority under 35 U.S.C. §119(a)-(d) or (f) to Japanese Patent Application No. 2014-082071 dated Apr. 11, 2014.

FIELD OF THE INVENTION

The invention generally relates to an electrical connector, and, more specifically, to a surface mount electrical connector.

BACKGROUND

A conventional surface mount connector of a horizontal type has a connector receiving space opened in a direction parallel to a surface of a circuit board. Contacts extend from a mating positioned in the connector receiving space to a terminating end outside the connector receiving space. The terminating ends are generally surface-mounted on the circuit board by soldering.

The contacts extend outward from of a terminating end of a connector housing, allowing the soldered terminating end fillets to undergo visual inspection, both from above the circuit board and the center of gravity of the surface mount connector upon mounting.

The connector housing is divided into a contact receiving portion holding contacts and a hooded mating portion to be mated with a mating connector (See for example, Japanese Patent Application No. 2009-117219 A). The contact receiving portion and the hooded mating portion are assembled to each other using an elastic member made of metal.

However, the convention design is difficult to position the contacts in multiple rows within the connector receiving space while drawing all the contacts out the terminating end of the housing. This is because it is difficult to draw all the contacts behind the housing in view of interference between contacts on the rear face side of the housing, constraint of a space on a circuit board required for surface mounting, and the like.

Therefore, though it is possible to achieve a multi-row configuration by folding some of contacts back on the rear face side of the housing and drawing them forward, it is difficult to inspect fillets of solders due to the obstruction by the hooded mating portion of the housing surrounding the contacts within the connector receiving space. Further, since it is necessary to position the hooded mating portion in front of the mating ends of the contacts within the connector receiving space, in order to prevent damage to the contacts, the mating ends of the contacts are concealed below the hood.

Alternatively, if the contacts are made longer, such that the mating ends are exposed from a mating end of the hooded mating portion, co-planarity (uniformity of the lowermost faces of the contacts) of the contacts is difficult.

As shown in JP 2009-117219 A, when the conventional housing is divided into the contact receiving portion and the hooded mating portion and mating ends of the contacts extending forward are further exposed from the contact receiving portion, a solder fillet inspection can be performed easily and the hooded mating portion can be assembled to the contact receiving portion after inspection. Since the hooded mating portion has a necessary length and it is unnecessary to extend the lead portions of the contacts forward, it is possible to prevent damage to the contacts while also maintaining their co-planarity.

However, in the conventional connector disclosed in JP 2009-117219 A, the number of parts increases, directly corresponding to the elastic member for assembling the contact receiving portion and the hooded mating portion of the housing to each other, which results in cost increase.

Further, when the conventional housing is divided to pieces, the contact receiving portion and the hooded mating portion rattle, due to a force or vibrations applied when a mating connector is plugged or unplugged, requiring these housing parts to be assembled securely.

In view of the problems described above, there is a need for a surface mount connector where inspection of the mating ends of contacts is easy, even if a multi-row configuration of the contacts is adopted, and the various individual components of the housing can be securely assembled using a reduced number of parts.

SUMMARY

A surface mount connector has a housing cover, a contact receiving base, and a first engagement portion. The contact receiving base is connected to the housing cover, having a plurality of contacts with terminating ends and opposite mating ends positioned inside the housing cover. The first engagement portion has a first projection positioned proximate to a mating end of either the housing cover or the contact receiving base, extending orthogonal to a plugging/unplugging direction. The first engagement portion also has a first projection receiving member positioned on the other of the contact receiving base and the housing cover proximate to the mating end, being complimentary to the first projection and receiving the first projection at a terminating end facing surface thereof.

BRIEF DESCRIPTION OF THE DRAWINGS

The invention will now be described by way of example, with reference to the accompanying Figures, of which:

FIG. 3(*b*) is a sectional view of the contact receiving portion taken along line IIIb-IIIb;

FIG. 4(*b*) is a cross-sectional view of the surface mount connector taken in the direction of arrow IV-IV of FIG. 3(*a*) where the housing cover projections are engaged with the complimentary projection receiving grooves on the contact receiving portion;

FIG. 5(*b*) is a cross-sectional view of the housing cover positioned on the contact receiving portion prior to mating;

FIG. 5(*c*) is a cross-sectional view of the housing cover being mated to the contact receiving portion; FIG. 6(*b*) is a cross-sectional view showing the process of assembling the ECU-case after mating has been performed.

DETAILED DESCRIPTION OF THE PREFERRED EMBODIMENTS

Embodiments of the invention will be described below with reference to the drawings.

A surface mount connector 1 ("connector 1") will be described with reference to FIGS. 1 to 4.

Figure 1:
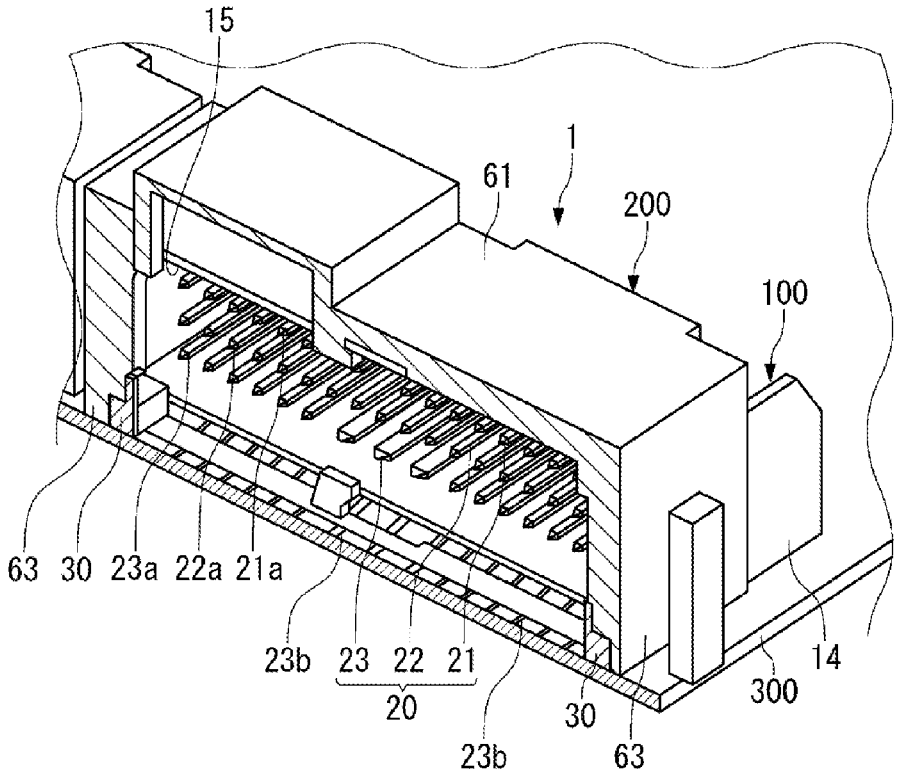
FIG. 1 is a perspective view of a surface mount connector.
Figure 2:
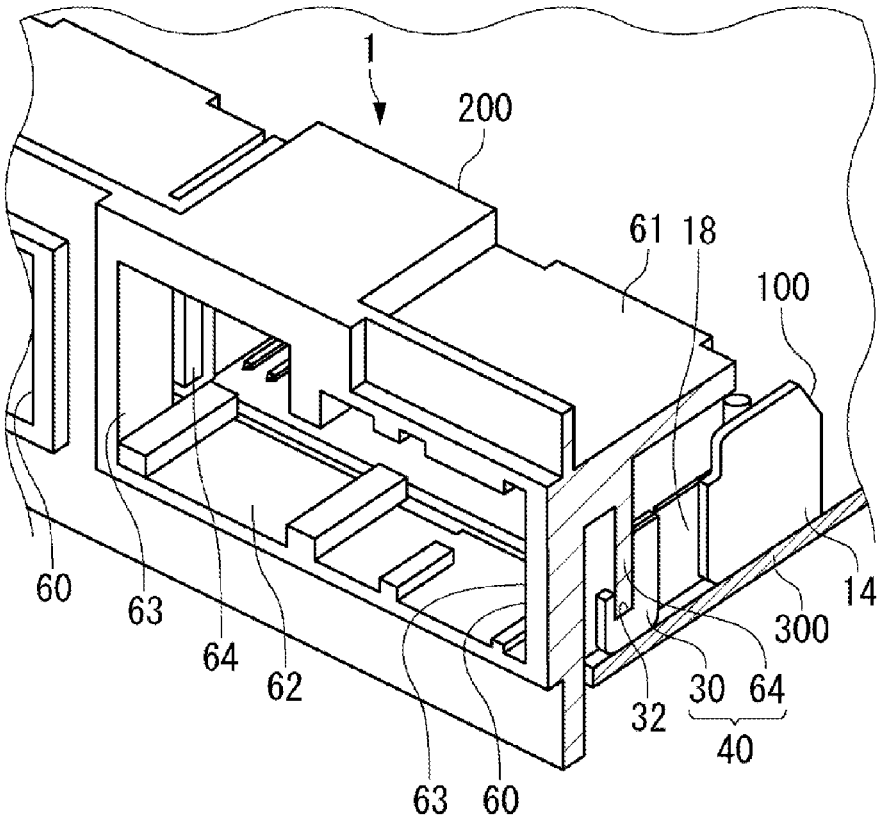
FIG. 2 is a partial cross-sectional view of the surface mount connector.

In the embodiments shown in FIGS. 1 and 2, the connector 1 includes a contact receiving base 100 having a plurality of contacts 20 to be surface-mounted on a circuit board 300, and a housing cover 200 to be mated with a mating connector (not shown).

The contact receiving base 100 and the housing cover 200 are each integrally formed of insulating resin by an injection molding process.

Figure 3A:
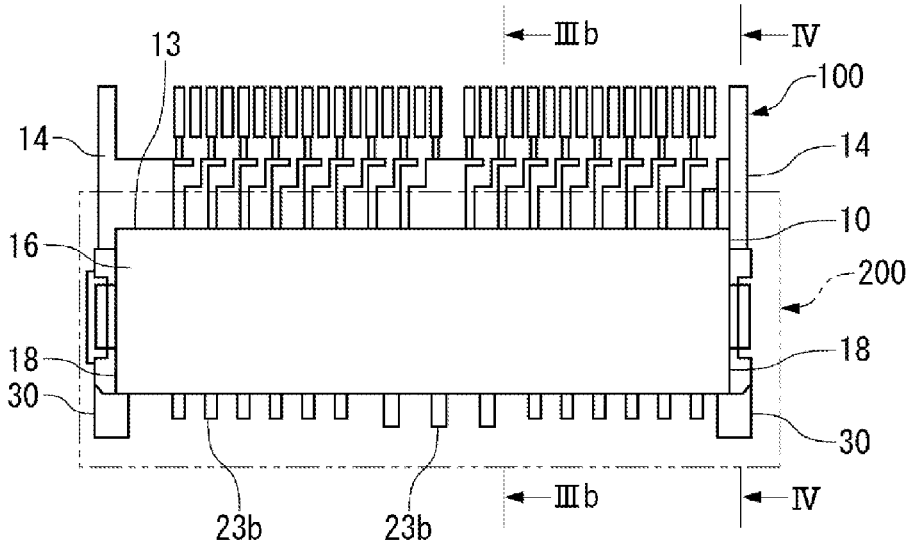
FIG. 3(*a*) is a plan view of a contact receiving portion of the surface mount connector.
Figure 3B:
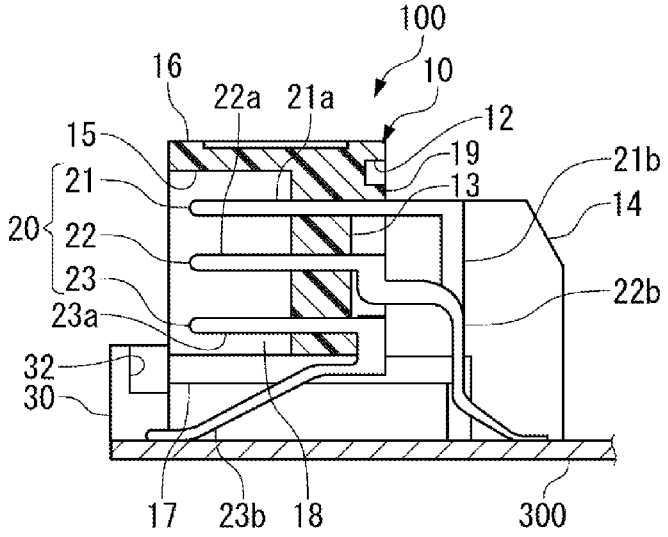

In the embodiment shown in FIG. 3(*b*), the contact receiving base 100 has an insulating housing 10 and a plurality of contacts 20 held by the housing 10.

The housing 10 has a rectangular mating connector receiving space 15 open in a direction parallel to a surface of the circuit board 300. A plurality of mating connector receiving spaces 15 are positioned in the housing 10, receiving complementary mating connectors (not shown) that may be inserted into these mating connector receiving spaces 15, respectively. The housing 10 is connected to the circuit board 300 by a fastening mechanism (not shown). A gap (described below) is positioned between the housing 10 and the circuit board 300 for drawing lower terminating ends 23*b* of lower contacts 23 described later.

The plurality of contacts 20 are positioned in the housing 10 in a plurality of rows within the mating connector receiving space 15.

In an embodiment shown in FIG. 3(*b*), the contacts 20 are positioned in three rows, having an upper row, a middle row, and a lower row.

Upper contacts 21 are positioned in the upper row, each having an upper mating end 21*a* positioned inside the mating connector receiving space 15, and an upper terminating end 21*b* drawn outside the mating connector receiving space 15.

The upper mating end 21*a* is to be electrically connected to a contact of a mating connector.

The upper terminating end 21*b* extends out of a terminating end of the contact receiving base 100, the terminating end being opposite to a mating side. A distal end of the upper terminating end 21*b* is to be electrically connected to a terminal pattern of the circuit board 300. In an embodiment, solder (not shown) is used in order to fix the distal end of the upper terminating end 21*b* to the circuit board 300, although in other embodiments, other known fastening mechanisms may also be used.

Middle contacts 22 are positioned in the middle row, each having a middle mating end 22*a* positioned inside the mating connector receiving space 15, and a middle terminating end 22*b* extending out to the terminating end of the contact receiving base 100 similar to the upper contacts 21.

Lower contacts 23 are positioned in the lower row, each having a lower mating end 23*a* positioned inside the mating connector receiving space 15, and a lower terminating end 23*b* folded back on a rear facing side of the contact receiving base 100 to extend forward towards the mating end of the contact receiving base 100. In an embodiment, the lower contacts 23 have a somewhat U-shape. The lower terminating end 23*b* extends forward through the contact receiving base 100 and between the contact receiving base 100 and the circuit board 300. A distal-most portion of the lower terminating end 23*b* is positioned forward of the mating end of the mating connector receiving space 15 of the contact receiving base 100. (See FIG. 3(*b*))

As shown by a two-dot chain line in FIG. 3(*a*), the housing cover 200 extends along the circuit board 300 up to a position where distal-most portions of the lower terminating ends 23*b* of the lower contacts 23 extend outward from the mating end beyond the contact receiving base 100.

The housing cover 200 has a rectangular mating connector receiving space 60 opened in a direction parallel to a surface of the circuit board 300. Regarding the mating connector receiving space 60, a plurality of mating connector receiving spaces 60 are positioned in the housing cover 200 so as to correspond to the respective mating connector receiving spaces 15 in the contact receiving base 100 (see FIG. 2).

The housing cover 200 is attached so as to cover a mating end of an outer periphery of the contact receiving base 100 and is to be mated with a complimentary mating connector.

Figure 4A:
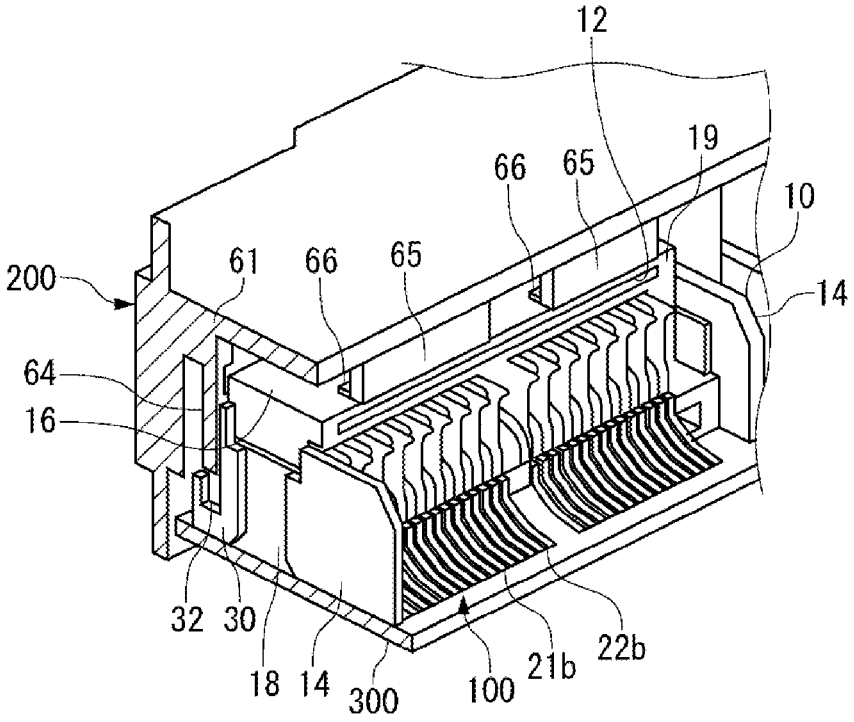
FIG. 4(*a*) is a cross-sectional view of the surface mount connector taken in the direction of arrow IV-IV of FIG. 3(*a*) prior to housing cover projections engaging with complimentary projection receiving grooves on the contact receiving portion.
Figure 4B:
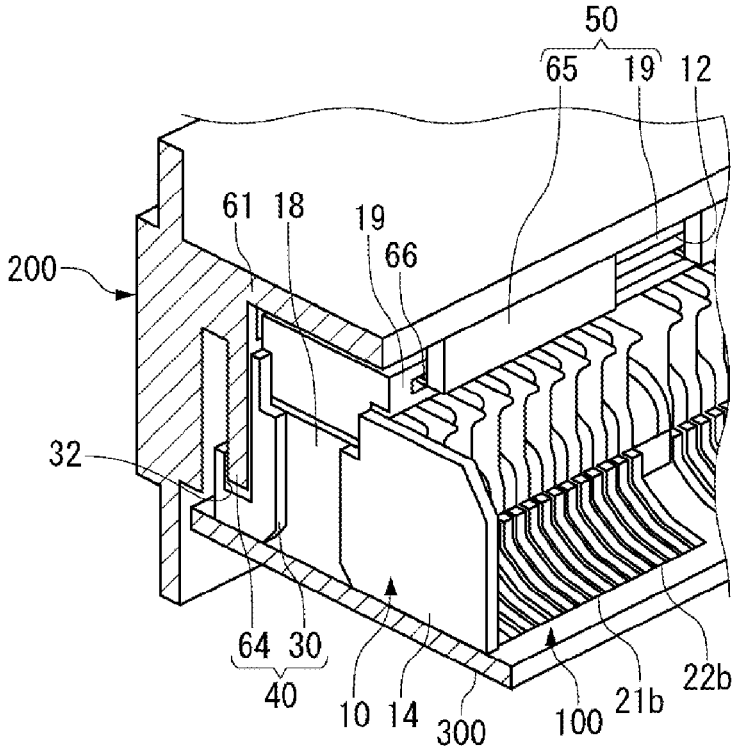

The contact receiving base 100 and the housing cover 200 are assembled to each other by a first engagement portion 40 and a second engagement portion 50 described below. As shown in FIG. 4(*b*), the first engagement portion 40 is positioned on a mating end relative to the second engagement portion 50, while the second engagement portion 50 is positioned on a terminating end relative to the first engagement portion 40.

The first engagement portion 40 has a first projection 64 disposed on the housing cover 200 and extending in an orthogonal direction intersecting a plugging/unplugging direction, and a complimentary first projection receiving member 30 is positioned in the contact receiving base 100, receiving the first projection 64 from a terminating end of the first projection 64.

The second engagement portion 50 is positioned on a terminating end of the housing cover 200 in the plugging/unplugging direction. The second engagement portion 50 has a latching arm 65 positioned in the housing cover 200 and extending in an orthogonal direction intersecting the plugging/unplugging direction. A latching projection 66 is positioned on a terminating end of the latching arm 65, extending towards the mating end. A complimentary latching arm receiving member 19 is positioned in the contact receiving base 100 and receiving the latching arm 65 from a mating end of the latching arm 65.

As shown in FIGS. 3(*a*) and 3(*b*), the housing 10 constituting the contact receiving base 100 has a contact holding wall 13 that receives and holds the plurality of contacts 20, and a reinforcing wall 14 projecting from the contact holding wall 13 in a terminating end direction and covering the contacts 20 from sides thereof.

The mating connector receiving space 15 formed in the housing 10 is defined by the contact holding wall 13, an upper wall 16, a lower wall 17 and a pair of side walls 18,18.

In the contact holding wall 13, a plurality of contact receiving passageways are formed by which the contacts 20 are inserted through the contact holding wall 13, being fixed therein.

Further, at a terminating end of the upper wall 16, the latching arm receiving member 19 of the second engagement portion 50 extends orthogonally from to the upper wall 16 towards the contact receiving base 100 (see FIG. 4(*a*)). A latching projection receiving groove 12 is positioned in the latching arm receiving member 19 extending into the latching arm receiving member 19 in a direction of the thickness of the latching arm receiving member 19. The latching projection receiving groove 12 has a complimentary shape to the latching projection 66 of the latching arm 65, and upon mating of the housing cover 200 to the contact receiving base 100, the latching projection 66 is positioned into the latching projection receiving groove 12

In the embodiments shown in FIGS. 4(*a*) and 4(*b*) and FIG. 2, first projection receiving members 30 of the first engagement portion 40 have an approximate J-shaped cross-section, and are positioned on a mating end side of the side walls 18 and 18 of the housing 10, respectively.

The first projection receiving member 30 has a first projection receiving groove 32 in which the first projection 64 of the housing cover 200 is inserted from above. The first projection receiving groove 32 has a generally recessed shape is open facing upwards towards the housing cover 200. Further, the first projection receiving groove 32 is positioned in front of a front edge of the housing 10.

As shown in FIGS. 3(*a*) and 3(*b*), in a state prior to assembling the housing cover 200 (shown as a two-dot chain line) to the contact receiving base 100, regarding all of the terminating ends 21*b*, 22*b*, and 23*b* of the contacts 21,22,23, including the lower terminating ends 23*b* of the lower contacts 23, fillets of solders can be inspected from above them.

As shown in FIG. 2, the mating connector receiving space 60 of the housing cover 200 is defined by an upper wall 61, a lower wall 62, and side walls 63 and 63. The first projections 64 of the first engagement portion 40 are respectively formed on inner faces of the side walls 63 and 63 so as to extend from the upper wall 61 downward towards the contact receiving base 100. The first projections 64 are inserted into the first projection receiving grooves 32 of the first projection receiving members 30 when the housing cover 200 is assembled to the contact receiving base 100.

Further, a total of four housing cover latching projections 69 are disposed on the upper wall 61, the lower wall 62, and the side walls 63 and 63, each engaging one complimentary case latching projections 70 (see FIG. 6) disposed on a corresponding ECU case 400.

As shown in FIGS. 4(*a*),4(*b*) and 3(*b*), the latching arms 65 of the second engagement portion 50 are cantilevered at a terminating end of the upper wall 61 of the housing cover 200 so as to extend downward toward the circuit board 300. The latching projections 66 (see FIG. 4(*a*)) extend in the plugging/unplugging direction, and are positioned on distal ends of the latching arms 65. When the housing cover 200 is assembled to the contact receiving base 100 from above, the latching arms 65 are elastically deformed. Then, the latching projections 66 of the latching arms 65 enter inside of the latching projection receiving groove 12 of the latching arm receiving member 19 to be caught by the latching arm receiving member 19.

An assembling procedure of the connector 1 will be described below with reference to FIG. 5 to FIG. 6.

The contacts 20 are firstly assembled to the contact receiving base 100 by inserting and press-fitting respective contacts 20 into the contact receiving passageways of the contact holding wall 13 on the contact receiving base 100. Next, the terminating ends 21*b* to 23*b* of the respective contacts 21 to 23 are surface-mounted on a terminal pattern on the circuit board 300 by soldering.

Thereafter, inspection of the fillets of solders is performed visually or through an image of the fillets to ensure proper attachment.

The contact receiving base 100 and the housing cover 200 are then assembled to each other by engaging the first engagement portion 40 with the second engagement portion 50.

Figure 5A:
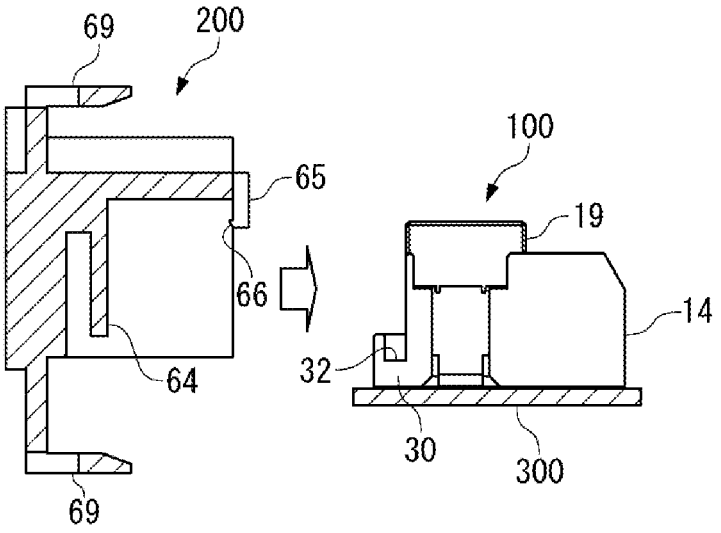
FIG. 5(*a*) is a cross-sectional view showing a process of assembling the housing cover to the contact receiving portion, prior to the housing cover being positioned on the contact receiving portion.
Figure 5B:
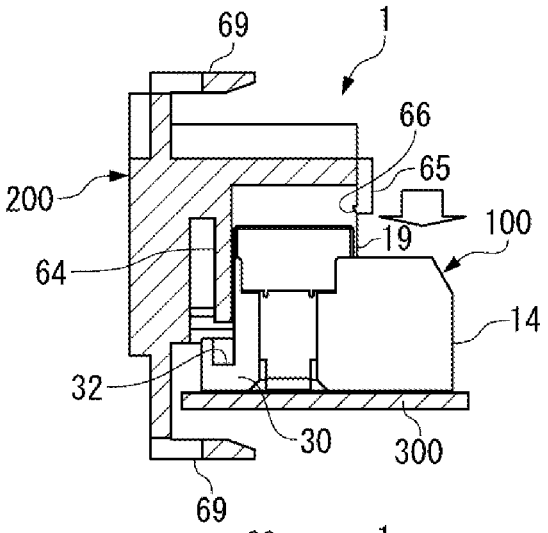
Figure 5C:
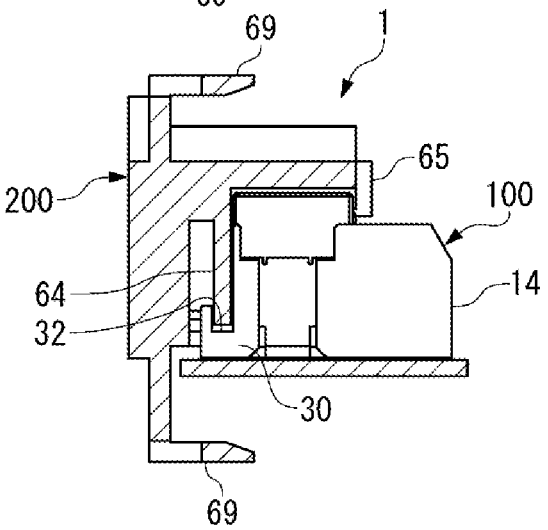
Figure 6A:
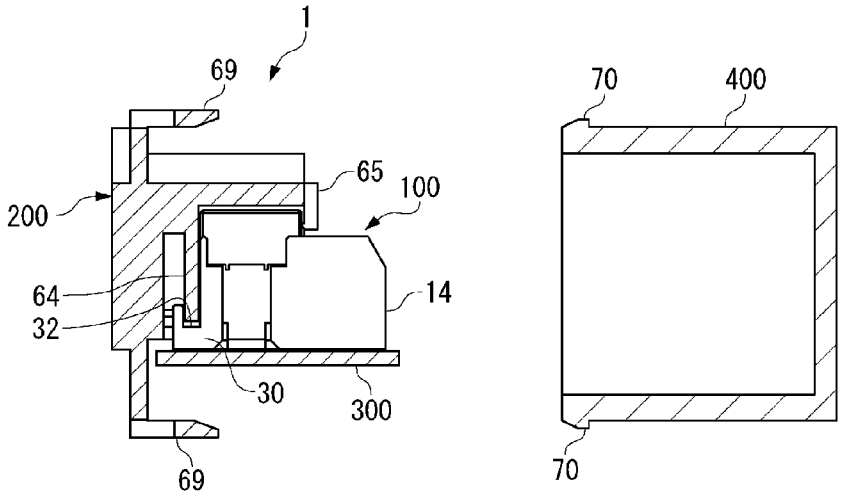
FIG. 6(*a*) is a cross-sectional view showing a process of assembling an ECU case prior to mating.
Figure 6B:
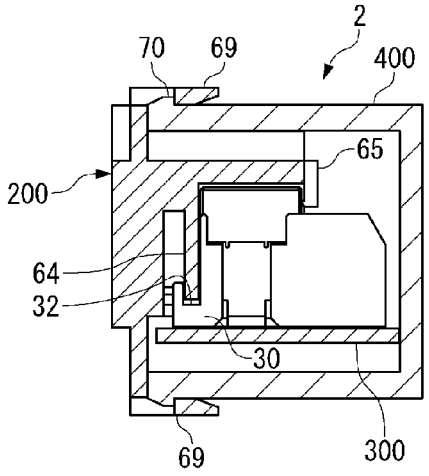

FIGS. 5(*a*) to 5(*c*) show an aspect where the first projection 64 and the first projection receiving member 30 of the first engagement portion 40 are engaged with each other. As shown in FIG. 5(*a*), the housing cover 200 is attached to the contact receiving base 100 from the mating end of the contact receiving base 100. Then, as shown in FIG. 5(*b*), after the first projection 64 of the housing cover 200 reaches a position of the first projection receiving member 30 of the contact receiving base 100, the housing cover 200 is moved downward towards the contact receiving base 100 to fit the first projection 64 into the first projection receiving groove 32.

Thereby, as shown in FIG. 5(*c*), the first projection 64 is caught by the first projection receiving member 30 from a terminating end thereof, so that a terminating end movement is restricted. Further, the first projection 64 is also caught by the first projection receiving member 30 from a mating end thereof. In addition, since the first projection 64 faces the side wall 63 of the housing cover 200, its movement toward the outer peripheral side is restricted.

When the housing cover 200 is moved downward towards the contact receiving base 100 from the state shown in FIG. 5(*b*) to the state shown in FIG. 5(*c*), the latching arm 65 and the latching arm receiving member 19 of the second engagement portion 50 are engaged with each other, as shown in FIG. 4(*a*) and FIG. 4(*b*). That is, the latching projection 66 of the latching arm 65 passes along the latching arm receiving member 19 and enters the latching projection receiving groove 12 while the latching arm 65 is being elastically deformed.

The assembling of the connector 1 is completed by assembling the housing cover 200 to the contact receiving base 100 according to the above procedure. The contact receiving base 100 and the housing cover 200 can be assembled to each other securely by the first engagement portion 40 and the second engagement portion 50 arranged to be spaced from each other both in the plugging/unplugging direction and in the vertical direction. A relative movement between the housing cover 200 and the contact receiving base 100 are restricted with respect to the plugging/unplugging direction, the vertical direction, and a widthwise direction orthogonal to the plugging/unplugging direction and the vertical direction by the first engagement portion 40 and the second engagement portion 50.

In an embodiment, the ECU case 400 is assembled to the connector 1. As shown in FIG. 6(*a*), the ECU case 400 is attached to the connector 1 from a terminating end of the connector 1. When the case latching projections 70 of the ECU case 400 engage the cover latching projections 69 of the housing cover 200, an ECU connector 2 is completed.

An operation and an advantageous effect of the connector 1 according to an embodiment will now be described.

In the connector 1, the first projections 64 of the housing cover 200 are received in the first projection receiving members 30 formed on the contact receiving base 100, and the latching projections 66 of the housing cover 200 are received in the latching projection receiving grooves 12 of the latching arm receiving members 19 on the contact receiving base 100. As such, the contact receiving base 100 and the housing cover 200 are connected to each other along a direction orthogonal to the plugging/unplugging direction.

Therefore, since additional latching members are not required for fixing the contact receiving base 100 to the housing cover 200, the number of parts needed can be reduced. As such, the manufacturing cost of the connector 1 the housing of which has been divided into two housing parts (the contact receiving base 100 and the housing cover 200) can be reduced.

Further, according to the connector 1 in this embodiment, the latching arm receiving member 19 receives the latching arm 65 from a mating end thereof in addition to the first projection receiving member 30 receiving the first projection 64 from a terminating end thereof. Therefore the first projection 64 and the latching arm 65 function as a wedge to a region positioned therebetween.

The contact receiving base 100 and the housing cover 200 are thus restricted regarding a relative movement therebetween in the plugging/unplugging direction or in an orthogonal direction in the plugging/unplugging direction.

Therefore, even in a multi-position connector 1 to which a large force is applied upon plugging/unplugging, plugging/unplugging of a mating connector can be performed stably without any significant play therebetween.

Further, since the housing cover 200 covers a mating end of the outer periphery of the contact receiving base 100, and the first projection receiving member 30 and the first projection 64 are engaged with each other inside the housing cover 200, the first projection 64 is prevented from moving to the outer peripheral side of the housing cover 200 and disengaging from the first projection receiving member 30.

In addition, since the first projection receiving groove 32 is formed on the mating end of the first projection receiving member 30, the first projection 64 can also be caught from a mating end of the first projection receiving member 30. In this connection, since the first projection receiving groove 32 is disposed in the first projection receiving member 30, positioned can be made easily when the housing cover 200 is assembled to the contact receiving base 100.

In an embodiment, when the contacts 20 are held in the contact receiving base 100, mating end portions of the lower terminating ends 23*b* of the lower contacts 23 are exposed in front of contact receiving base 100. Therefore, whether or not respective terminating ends 21*b*, 22*b*, and 23*b* of all the contacts 21 to 23 held by the contact receiving base 100, including the lower contacts 23, have been surface-mounted on the circuit board 300 properly can be inspected easily, for example, based upon a visual inspection, an image or the like from above the circuit board.

Since the housing of the connector 1 is divided into the contact receiving base 100 and the housing cover 200, a solder fillet inspection can be performed easily without the need to extend the lower terminating ends 23*b* of some lower contacts 23 further out of the mating end to expose them beyond the mating end of the cover housing 200, or without the need to shorten the housing cover 200. Therefore, the co-planarity of the contacts 20 can be secured.

Since a housing portion is secured sufficiently in front of the mating ends 21*a*,22*a*,23*a* of the contacts 20 by attaching the housing cover 200 to the contact receiving base 100, prying of a contact 20 can be prevented.

Those of ordinary skill in the art would appreciate that one may select from the elements disclosed in the above-described embodiments or perform modifications to other elements in addition to this embodiment without deviating from the scope and spirit of the invention.

The connector 1 may be applied to various electronic devices in addition to the ECU connector 2. The electronic device is provided with the connector 1, the circuit board 300 on which the connector 1 is mounted, and a case which houses the connector 1 and the circuit board 300.

In an embodiment, when the cover latching projection 69 is not positioned in the housing cover 200, the housing cover 200 can be assembled to the contact receiving base 100 by simply moving the housing cover 200 downward towards the surface of the circuit board 300.

Further, the first engagement portion 40 and the second engagement portion 50 can incorporate other various elements in different embodiments. In such embodiments, the first projection 64 may be positioned on a side of the contact receiving base 100, while the first projection receiving member 30 is positioned on a corresponding side of the housing cover 200. Similarly, such a configuration can be adopted that the latching arm 65 is positioned on the side of the contact receiving base 100, while the latching arm receiving member 19 is positioned on the corresponding side of the housing cover 200.

Further, both of the first projection 64 and the latching arm 65 have been positioned on the housing cover 200, but in other embodiments, a member provided with the first projection 64 and a member provided with the latching arm 65 may be different members.

In addition, the latching arm 65 of the first projection 64 and the latching arm 65 serves as a locking member for preventing the contact receiving base 100 and the housing cover 200 from being separated from each other. However, in another embodiment, a configuration that a lock member for catching the contact receiving base 100 and the housing cover 200 in a direction orthogonal to the circuit board 300 may be provided in addition to the first projection 64 and the latching arm 65.

What is claimed is:

1. A surface mount connector comprising:

a housing cover;

a contact receiving base connected to the housing cover and having a plurality of contacts with terminating ends and opposite mating ends, the opposite mating ends positioned inside the housing cover;

a first engagement portion having a first projection positioned on a side of either the housing cover or the contact receiving base proximate to a mating end of the housing cover or contact receiving base, extending orthogonal to a plugging/unplugging direction, and a first projection receiving member positioned on the other of the contact receiving base and the housing cover proximate to a mating end of the housing cover or contact receiving base, being complementary to the first projection and receiving the first projection; and a second engagement portion having a latching arm positioned on an opposite terminating end of either the housing cover or the contact receiving base, extending orthogonal to the plugging/unplugging direction, and a latching arm receiving member positioned on the other of the housing cover and the contact receiving base and receiving the latching arm.

2. The surface mount connector according to claim 1, wherein at least one of the first projection and the latching arm is cantilevered.

3. The surface mount connector according to claim 2, wherein a latching projection is positioned on a distal end of the first projection or the latching arm.

4. The surface mount connector according to claim 3, wherein the latching projection extends toward the plugging/unplugging direction.

5. The surface mount connector according to claim 4, wherein the latching projection is positioned in a complementary recessed portion disposed in the first projection receiving member or the latching arm receiving member mating with the projection.

6. The surface mount connector according to claim 1, wherein the housing cover covers at least a mating end of an outer periphery of the contact receiving base.

7. The surface mount connector according to claim 1, wherein the first projection of the first engagement portion is positioned on the housing cover.

8. The surface mount connector according to claim 7, wherein the first projection receiving member is positioned on the contact receiving base.

9. The surface mount connector according to claim 1, wherein the latching arm is positioned in the housing cover, extending towards the contact receiving base.

10. The surface mount connector according to claim 9, wherein a latching projection is positioned on a distal end of the latching arm, extending towards the mating end.

11. The surface mount connector according to claim 10, wherein the latching arm receiving member is positioned in the contact receiving base, and has a latching projection receiving groove extending across a terminating end facing surface thereof.

12. The surface mount connector according to claim 11, wherein the latching projection is positioned in the latching projection receiving groove when the housing cover is connected to the contact receiving base.

13. The surface mount connector according to claim 1, further comprising a plurality of first projection receiving members, wherein each first projection receiving member has an approximate J-shaped cross-section.

14. The surface mount connector according to claim 13, wherein the contact receiving base has a pair of sidewalls, and one first projection receiving member is positioned on a mating end side of each sidewall.

15. The surface mount connector according to claim 14, wherein each first projection receiving member has a first projection receiving groove having a generally recessed shape, and being open facing upwards towards the housing cover.

16. The surface mount connector according to claim 15, wherein a plurality of first projections are disposed on the housing cover, extending downward towards the first projection receiving grooves.

17. The surface mount connector according to claim 16, wherein the first projections are received in the first projection receiving grooves when the housing cover is connected to the contact receiving base.

* * * * *